US005259509A

United States Patent [19]

Boal, Jr. et al.

[11] Patent Number: 5,259,509

[45] Date of Patent: Nov. 9, 1993

[54] STACKABLE STORAGE TANK

[76] Inventors: Stewart Boal, Jr.; Susan H. Boal, both of 3806 Northwood Ave., Peoria, Ill. 61614; Philip W. Moore, 7894 Bozman Neavitt Rd., Bozman, Md. 21612

[21] Appl. No.: 847,725

[22] Filed: Mar. 9, 1992

[51] Int. Cl.[5] ..... B65D 21/02

[52] U.S. Cl. ..... 206/597; 206/599; 206/508; 206/509; 220/571; 220/DIG. 6

[58] Field of Search ..... 206/509, 503, 508, 599, 206/380, 597; 220/DIG. 6, 601, 636, 571

[56] References Cited

U.S. PATENT DOCUMENTS

| | | | |
|---|---|---|---|
| 3,389,830 | 6/1968 | Smith | 206/509 |
| 3,980,185 | 9/1976 | Cain | 206/509 |
| 4,173,288 | 11/1979 | Schutz | 206/509 |
| 4,372,444 | 2/1983 | Le Grand et al. | 206/509 |
| 4,456,142 | 6/1984 | Burling | 206/509 |
| 4,573,603 | 3/1986 | Starling et al. | 206/509 |
| 4,721,235 | 1/1988 | Watson . | |
| 4,756,417 | 7/1988 | Teixzira | 206/509 |
| 4,793,491 | 12/1988 | Wolf et al. | 206/509 |

OTHER PUBLICATIONS

Snyder Industries, Inc., Vertical Tanks.

Hoover Group Incorporated, Duratank, November 1991; Liquitote Polytanks, Nov. 1991; Cage Liquitote, Sep. 1989; Bulkdrum, Nov. 1991; GB-165 Grease Bin.

Aco-Assmann of Canada Ltd., PTC Pallet Tank Container System.

Fabricated Metals, Inc., Vertical Liqua-Bin with barrel manhole and quarded fitting, Feb. 1978.

W/W Engineering Co., Bulk Storage Tanks, Bulletin No. 412.

Clawson Tank, Jumbo Portable Shipping Containers.

Macro Plastics Incorporated, MacroTank.

Orbitron Industries, 175 Gallon Vertical Mini-Bulk Storage Tank System, 1988; Orbitron/Rotec 120 & 200 Gallon Vertical Mini-Bulk Storage Tank Systems, 1985.

ROTEC Incorporated, Specification and Selection Guide for the ROTEC Family of Storage, Transport and Application Tanks, 1984.

Bleach Tanks; Closed Head Bulk Storage Tanks; Bulk Forklift Container; Mini-Bulk Tank.

McMaster-Carr Supply Company, Lever Handle Wastes, Model No. 2907K44.

ARAG, Smooth Line, Threaded Lids "Smooth Line" Series with Breather Cap.

*Primary Examiner*—Joseph Man-Fu Moy

*Attorney, Agent, or Firm*—Cushman, Darby & Cushman

[57] ABSTRACT

A stackable portable container assembly for storing fluid having a pallet base and a tank having top, middle and bottom portions. The top portion can be integral with the tank or removable from the middle portion. A plurality of cables removably secure the tank to the pallet base. The bottom portion and an upper surface of the pallet base comprise cooperating male and female receptacles which are adopted to cooperate with each other when the tank is mounted to the pallet base. The bottom portion further comprises at least one drain. A drain valve coupled to the drain of the tank to enable the fluid stored in the tank to be removed at a predetermined rate. A lever-operated drain stopper is optionally disposed in the tank to prevent the fluid from flowing through the drain opening. The top portion comprises projections which cooperate with the pallet base of a second portable container assembly to enable the second portable container assembly to be securely stacked on top of the portable container assembly and the pallet base further comprises openings adopted to cooperate with projections on a top portion of the second portable container assembly to enable the portable container assembly to be mounted on top of the second portable container assembly.

13 Claims, 10 Drawing Sheets

STACKABLE STORAGE TANK

BACKGROUND OF THE INVENTION

1. Field of the Invention

The present invention relates to a stackable, portable container for storing and transporting semisolid and fluid materials and comprising a tank secured to a pallet base, the tank having a drain and an optionally removable top having at least one removable section for creating an opening in the top.

2. Description of the Related Art

Many industries are involved in the manufacture of liquid or semisolid products such as chemicals, solvents or the like (hereinafter "fluids"). Once produced, the need often arises for large quantities of these fluids to be transported from their place of manufacture to another manufacturing facility or directly to a consumer. In preparing to transport the fluid, it is common to transfer the fluid from a stationary manufacturing "vat" or the like into a smaller, portable container such as a drum, keg or barrel. These containers are then loaded onto the shipping vehicle and transported to their destination.

During transportation, the motion of the shipping vehicle can cause the containers to shift and become damaged thereby spilling the fluid or causing a safety hazard. Also, containers which are strewn about the vehicle during shipping are difficult to unload.

Once the portable containers are received at the destination, the fluid is either removed from the containers and used by the consumer or stored for future use. In many cases, the emptied containers will simply be discarded thus resulting in much waste. In addition, transferring the fluid from these portable containers into mixing vats or other similar apparatus is time consuming, requires additional manpower, and is often awkward and messy. Furthermore, many manufacturing facilities do not have adequate storage space and are forced to stack the containers, either empty or full, on top of one another thus posing a potential hazard if the containers are not stacked properly.

SUMMARY OF THE INVENTION

An object of the present invention is to eliminate the above problems by providing a durable, re-usable portable container for storing and transporting fluids. The portable container is designed to enable the fluid to be mixed and shipped in said portable container thereby eliminating the need to transfer the fluid from a mixing container to a shipping container. The portable container is further capable of being stacked in a stable manner on top of a like portable container.

To achieve this object, a portable container having a pallet base and a tank section having top, middle and bottom portions is provided. The tank is preferably cylindrical but can be a variety of shapes. Also, the top can be integral with the tank or removable according to design preference.

The cylindrical tank is removably secured to the pallet base by cables and is preferably constructed of a translucent material to enable the contents of the cylindrical tank to be viewed through the tank wall. Of course, other means such as bracketing fixtures or the like for removably securing the cylindrical tank to the pallet base can be used. The pallet base is formed to cooperate with the top portion of the cylindrical tank section to enable a plurality of the portable containers which are assembled to pallets (a container and pallet comprising a container assembly) to be stacked one upon the other in a vertical direction. If stacking of the container assemblies is contemplated, the container must be strong enough not only to contain the fluid but to support one or more container assemblies that may be stacked thereon.

At least one drain opening is provided in the bottom of the cylindrical tank. A drain hose made of a flexible tube or any other suitable material is attached to a fitting which further attaches to the drain opening in the bottom of the cylindrical tank to allow the fluid to be drained from the tank. The drain hose is equipped with a lever-operated valve to prevent the fluid from leaking from the tank at an unwanted time and to permit discharge of the tank contents when desired. The valve is further secured to the pallet base with a bracket assembly made of steel or the like which cooperates with the top portion of the tank during stacking.

The inner bottom portion of the cylindrical tank is contoured and sloped to direct the fluid toward the drain opening thus permitting emptying of the cylindrical tank without the necessity of tipping the tank. The exterior downwardly facing bottom surface of the tank and the upwardly facing tank supporting surface of the pallet base are formed to provide male and female elements adapted to mate or interfit together to positively locate the tank and pallet with respect to each other and to restrain or prevent relative lateral movement therebetween. The exterior bottom surface of the tank may form a male projection such as an outwardly convex surface in which case the upwardly facing tank support surface is formed to provide a female tank supporting surface which has an outwardly and upwardly facing concave surface that will mate with the convex bottom surface of the tank. Alternatively, the exterior outwardly facing bottom surface of the tank can be formed to provide a female receptacle such as an outwardly facing concave surface and the upper surface of the pallet can be provided with a correspondingly curved upwardly facing convex supporting surface that will nest within the concave bottom surface of the tank.

The top of the cylindrical tank can be integral with or removably secured to the cylindrical tank to prevent the fluid from spilling out of the cylindrical tank and to further prevent contaminants or impurities from entering the tank. The top is constructed to have at least one removable portion which is removed to create an opening in the top. Through this opening, more fluid may be added or a mixing device may be inserted to stir the fluid in the tank. One of the removable portions can act as a breather cap through which gases can escape or enter and fluid can be added or removed via a conventional hose and pump mechanism when the breather cap is removed. However, any removable portion can be equipped with a breather cap or breather valve to enable gases to escape or enter and fluid to be added or removed as described above.

BRIEF DESCRIPTION OF THE DRAWINGS

Like numerals represent identical components in the following Figures.

DETAILED DESCRIPTION OF THE PREFERRED EMBODIMENTS

Figure 1:
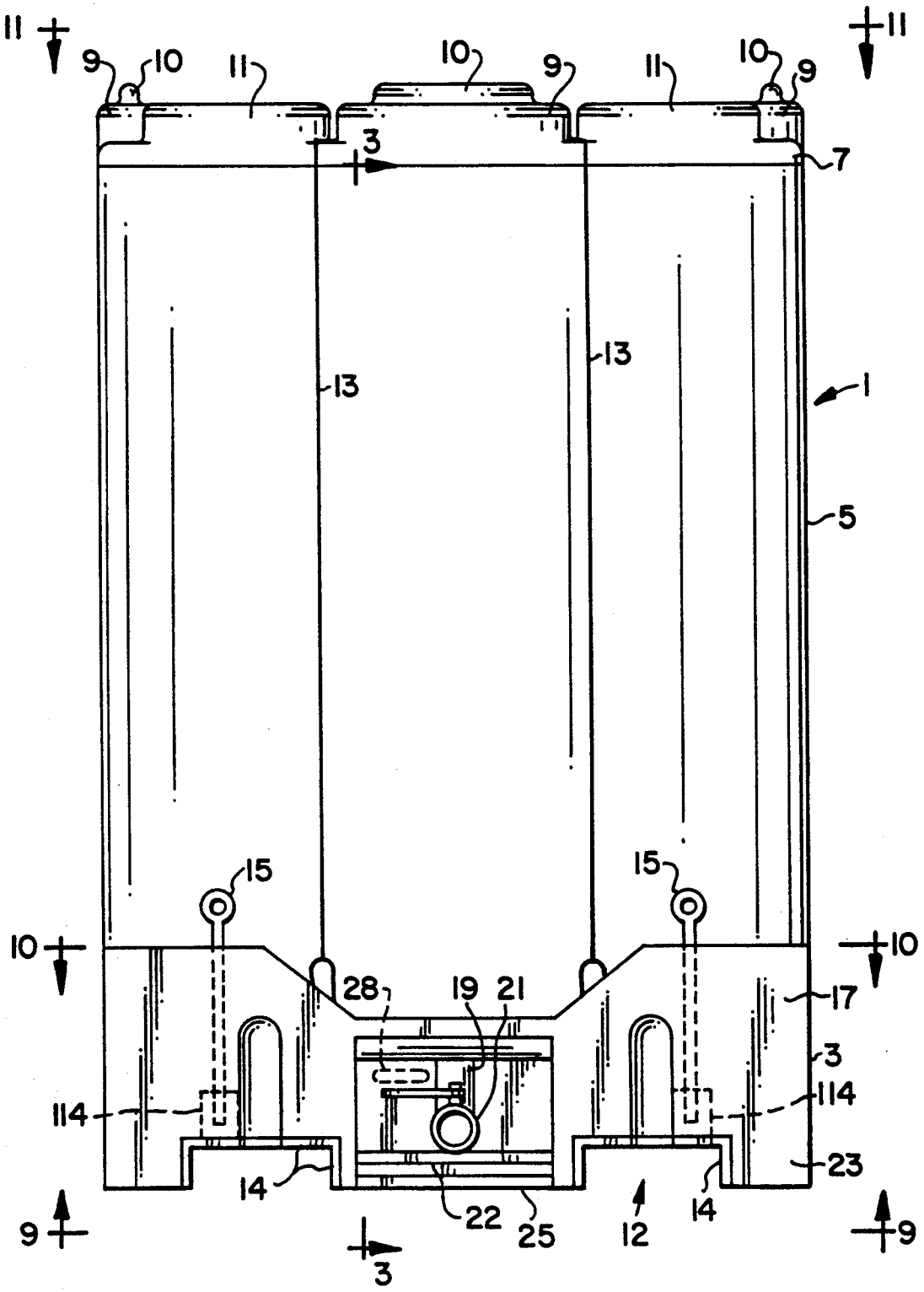
FIG. 1 is a side view illustrating the portable container apparatus comprising the tank assembled to the pallet according the present invention.
Figure 2:
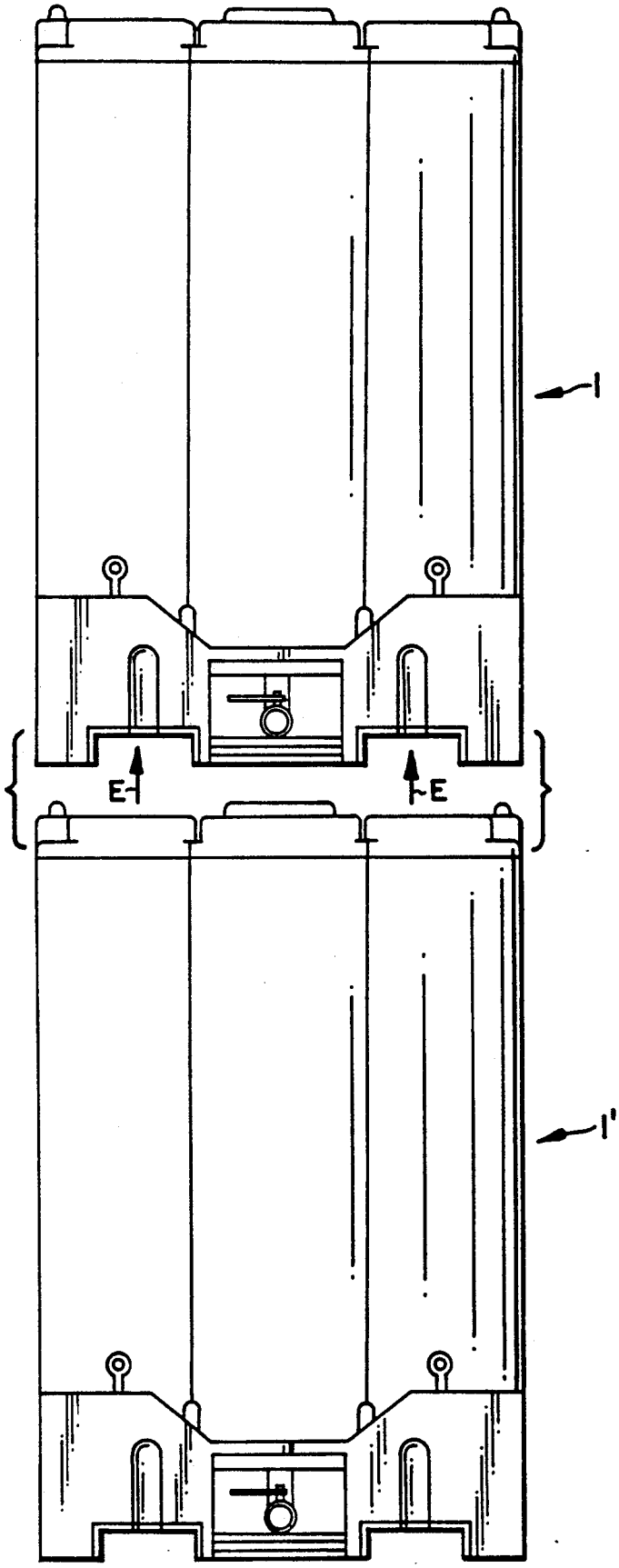
FIG. 2 illustrates stacking of two portable container assemblies of the present invention.

The portable container assembly 1 of the present invention is shown in FIG. 1. The portable container assembly 1 comprises a pallet base 3, a tank 5 and a top 7 made of low density polyethylene. Alternatively, the pallet base 3, tank 5 and top 7 can be made of high density polyethylene, cross linked polyethylene or any other suitable material. The overall height of the portable container assembly 1 in this example is approximately 62 inches, however, this height can be varied according to design preference. As shown in FIG. 2, like portable container assemblies 1 and 1' are capable of being stacked upon each other as indicated by arrows E.

The top can be removable or integral with tank 5 and comprises first projections 9 which each include an upper projection 10 of reduced lateral extent, and second projections 11. The first and second projections 9 and 11 are spaced from one another and disposed about the perimeter of the top 7. The tank 5 is removably mounted on top of the pallet base 3 and is secured to the pallet base 3 with fastening cables 13 made of metal or any other suitable cable material. Alternatively, other devices such as bracket fixtures or the like (not shown) can be used to removably secure the tank 5 to the pallet base 3. Each of the fastening cables 13 pass around one of the first projections 9 and are fastened at opposite ends with screws, bolts or the like to adjacent ends of adjacent corner section 17 of the pallet base 3 thereby securing the tank 5 to the pallet base 3. Alternatively, the fastening cables 13 can pass around one of the second projections 11 and be fastened to corner sections 17 of the pallet base 3. Furthermore, the fastening cables 13 can be strapped in any configuration across the top of the tank 5 and secured to any corner section(s) 17 of the pallet base 3 according to design preference (e.g. fastening cables 13 can be strapped across the top 7 and fastened to opposite corner sections 17). To remove the tank 5 from the pallet base 3, the fastening cables 13 are disconnected from their respective corner section(s) 17.

Laterally extending openings 12 are present in the pallet base 5 extending along the entire pallet base between the vertical side projections 23 and the central projection 25 (also see FIG. 9) to enable the pallet base 5 alone or the entire portable container assembly 1 to be lifted by a fork-lift or other similar machinery. Reenforcing elements such as channels 14 made of steel or the like can be secured to the laterally extending openings 12 so as to extend throughout their length to provide added support to the pallet base 5. The reenforcing channels 14 can be "U" shaped in cross-section to conform with the laterally extending openings 12 as shown in this embodiment or the reenforcing channels can have any other suitable cross-sectional configuration shape. The reenforcing channels 14 include threaded standoffs 114 disposed at predetermined locations (preferably symmetrical) on the reenforcing channels 14 as shown by broken lines in FIGS. 1 and 9. Lifting hooks 15, preferably being symmetrically disposed and made of steel or the like are removably secured, for example, as by being screwed into the threaded standoffs 114 of the reenforcing channels 14 through each corner section 17 of the pallet base 3 to secure the reenforcing channels 14 to the pallet base 3 and to enable the pallet base 3 or entire portable container assembly 1 to be lifted by an overhead crane or other lifting device.

At least one drain hose 19 is coupled to a fitting 20 which is further coupled to the drain opening 33 (see FIG. 3) in the bottom of the tank 5 to allow the fluid to be drained from the tank 5. The fitting 20 and drain opening 33 can be equipped with threads (not shown) to enable the fitting to be screwed into the drain opening 33. The drain hose 19 is preferably flexible and the fitting 20 is preferably made of stainless steel, plastic or the like, however, both the drain hose 19 and the fitting 20 can be made of any suitable material. The drain hose 19 is equipped with a drain valve 21, such as a conventional 2 inch plastic or bronze ball valve optionally mounted to the pallet base 5, to prevent the fluid from leaking from the tank 5 at an unwanted time. A bracket assembly 22 made of steel or the like is secured to the pallet and secures the drain valve 21 to the pallet base 5. In this embodiment, the drain valve 21 is secured proximate to the perimeter of the pallet base. Hence, the portable container assembly 1 is thereby equipped with a center drain (drain opening 33 in tank 5) and a side discharge (drain valve 21).

Figure 3:
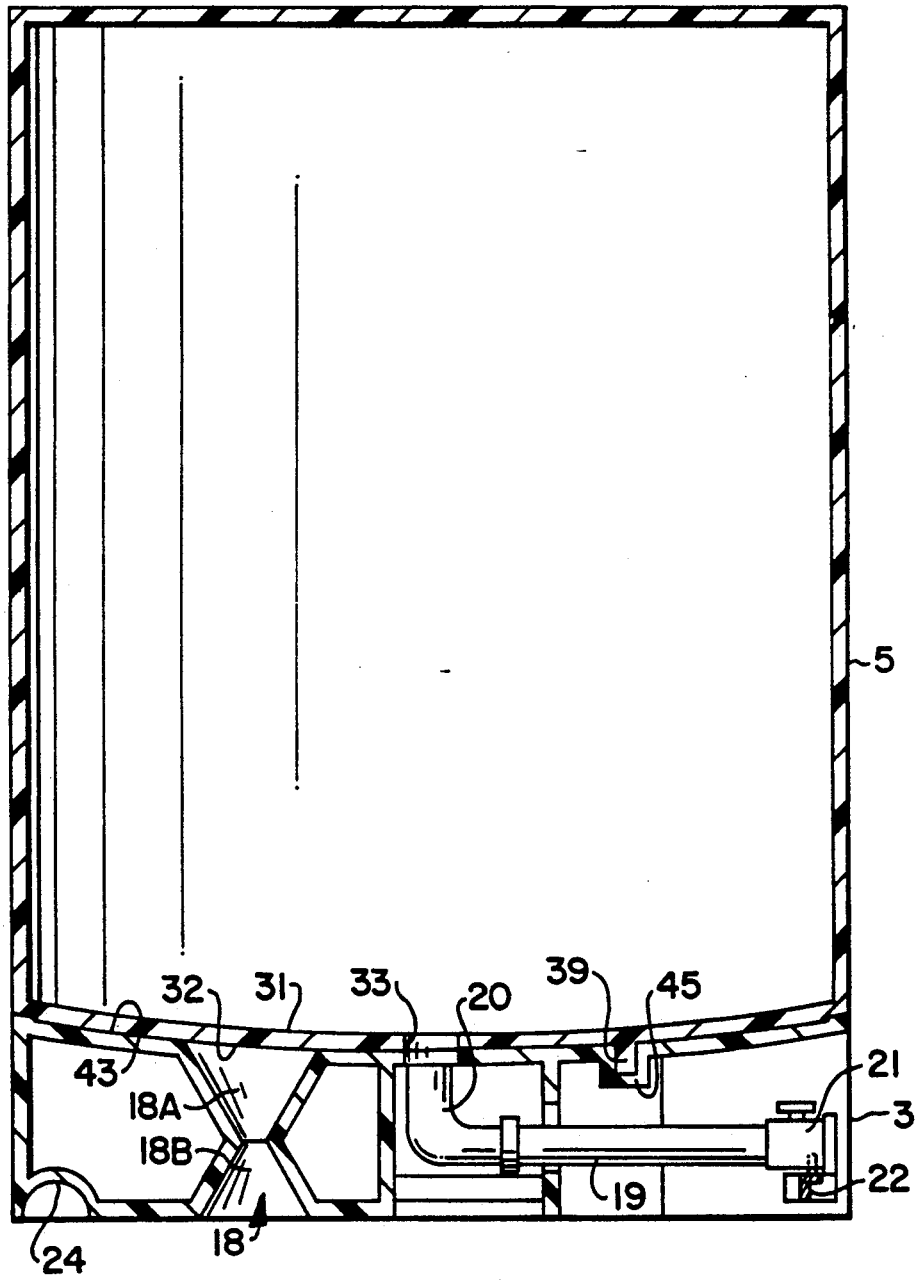
FIG. 3 illustrates a vertical cross section of the tank and pallet base along direction 3—3 in FIG. 1.

As shown in FIG. 3, the tank 5 in this embodiment is generally cylindrical throughout its length and has an outer diameter of approximately 48 inches with a storage capacity of approximately 350 gallons. The outer diameter and inner diameter along with the storage capacity can be varied according to design preference. Furthermore, as stated above, the tank 5 is constructed of a translucent material such as polyethylene or the like to allow the level of the fluid in the tank 5 to be viewed through the sidewall of the tank.

The tank 5 comprises inner and outer bottom surfaces 31 and 32, respectively, having at least one drain opening 33 therein. The height of the tank 5 in this embodiment lengthwise along a side of the tank 5 is approximately 45 inches but can be varied according to design choice. Also, in this embodiment, the drain opening 33 is located at the center of the inner and outer bottom surfaces 31 and 32. However, there can be more than one drain opening 33 and each drain opening 33 can be disposed at any location in the bottom of the tank or in the bottom of the cylindrical wall. In each case, the inner bottom surface 31 is contoured and sloped to direct the fluid toward the drain opening(s) 33 thus allowing the tank 5 to be emptied without tipping.

Figure 3A:
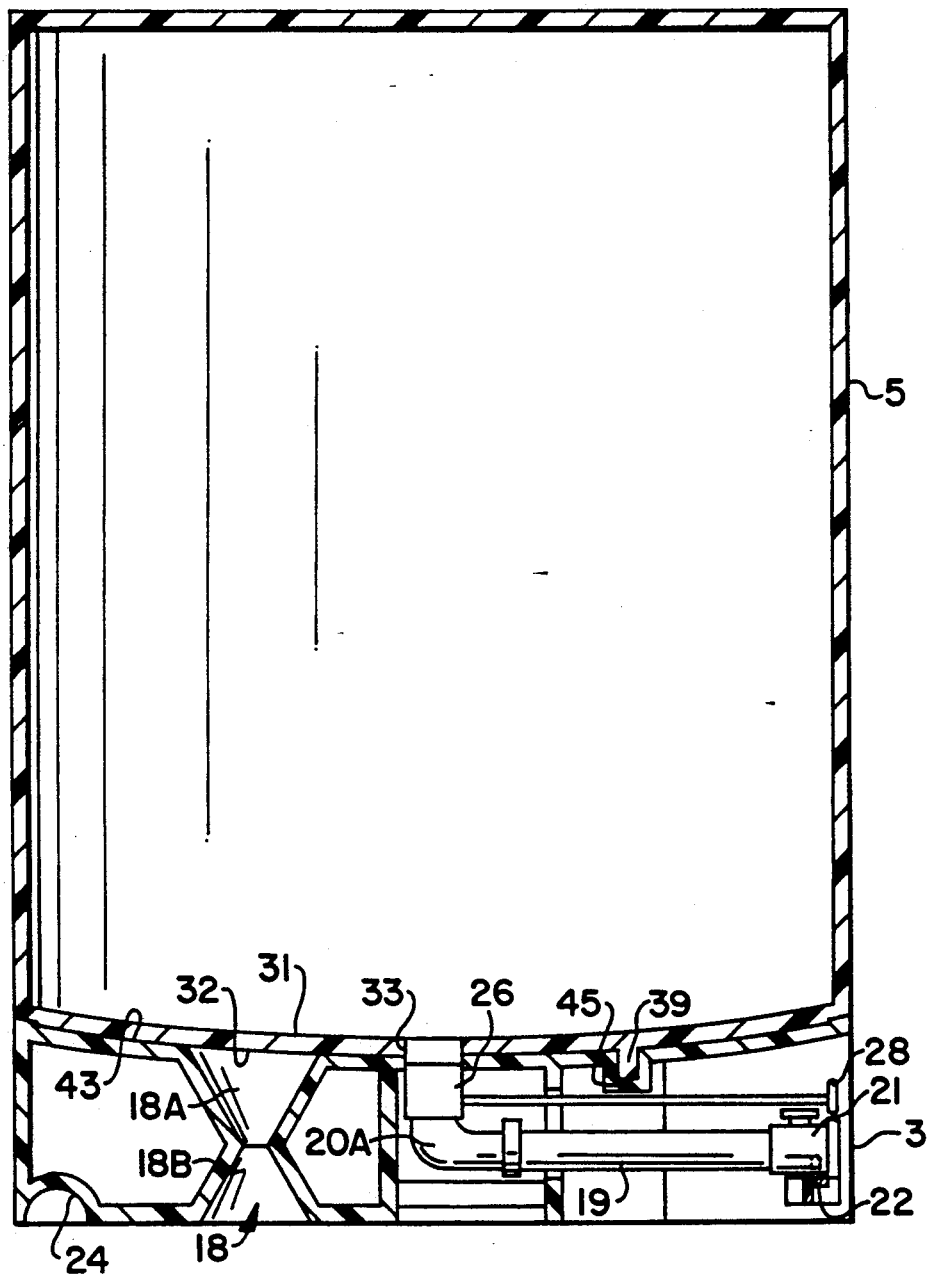
FIG. 3A illustrates another embodiment of a vertical cross section of the tank and pallet base along direction 3—3 in FIG. 1 wherein the fitting contains a drain stopper.

As illustrated in FIG. 3A, an external lever-operated drain stopper mechanism 26 can be coupled between an optional fitting 20A and the drain opening. Stopper mechanism 26 comprises a stopper therein and an externally operated lever 28 (also shown by broken lines in FIG. 1) for moving the stopper to open and closed positions. In the closed state, the drain stopper mechanism 26 causes the drain stopper to prevent the fluid stored in the tank 5 from exiting the tank 5 into the elbow shaped portion of the fitting 20A. Alternatively, in the open state, the drain stopper mechanism 26 positions the drain stopper to allow the fluid stored in the tank 5 to exit the tank and thus flow through the fitting 20A. The lever operated drain stopper mechanism can be of a conventional construction such as a Lever Handle Wastes, model no. 2907K44, distributed by McMaster-Carr Supply Company of Chicago, Ill..

Figure 4:
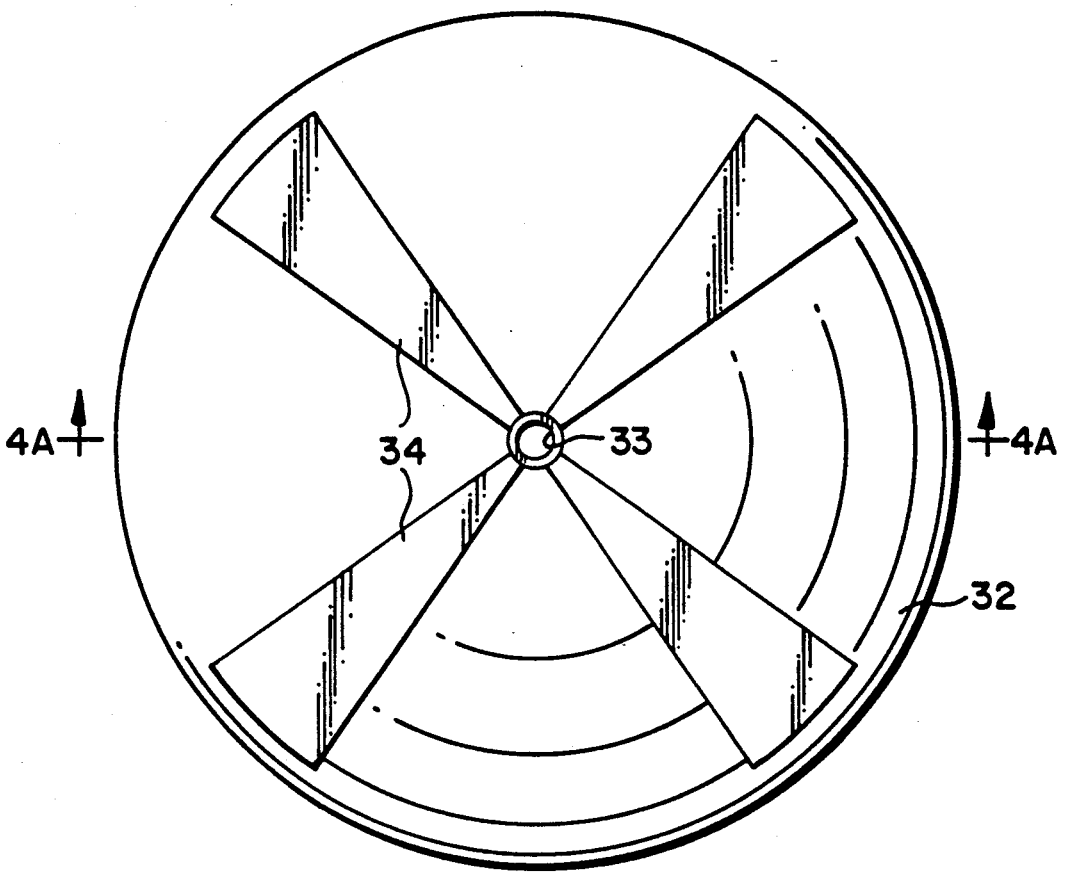
FIG. 4 is a plan view of the bottom of the container showing a modified bottom configuration.
Figure 4A:
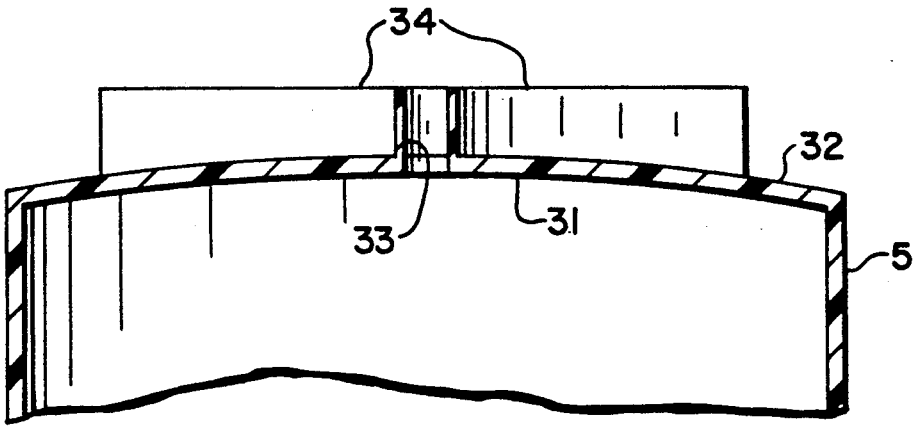
FIG. 4A is a sectional view taken along line 4A—4A of FIG. 4 with the container inverted.
Figure 5:
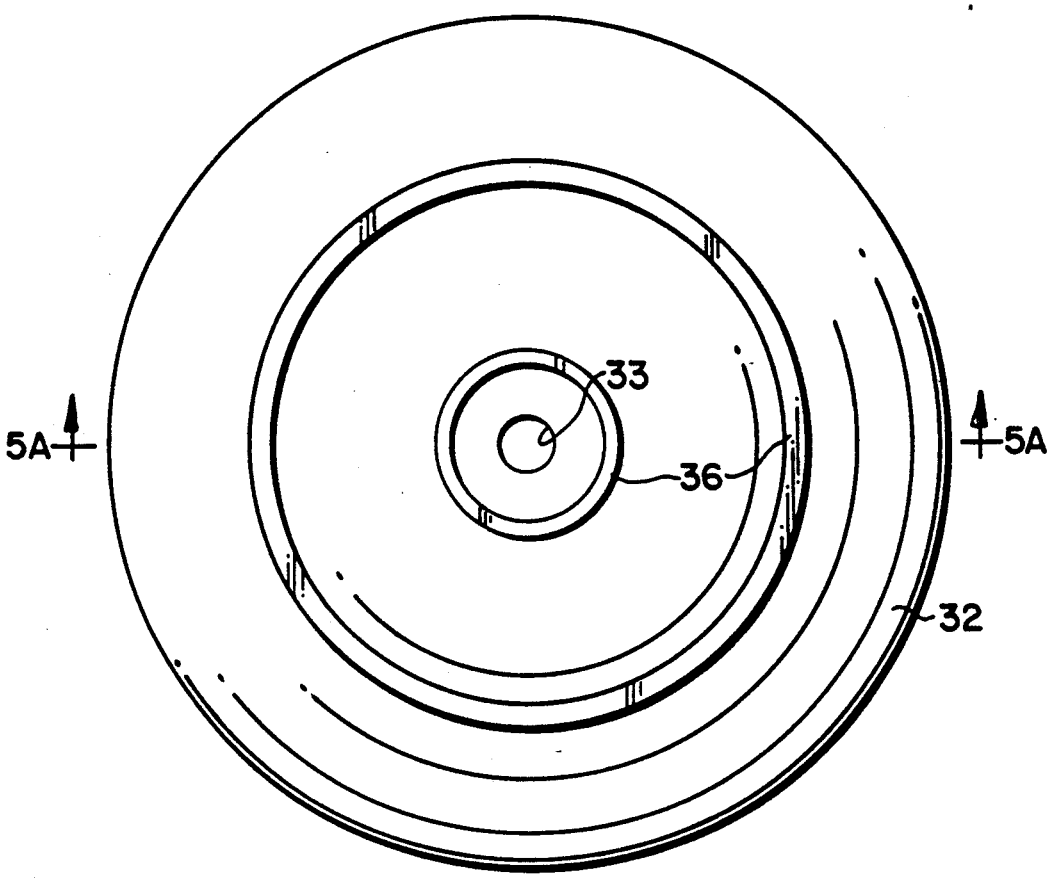
FIG. 5 is a plan view of the bottom of the container showing another modified bottom configuration.
Figure 5A:
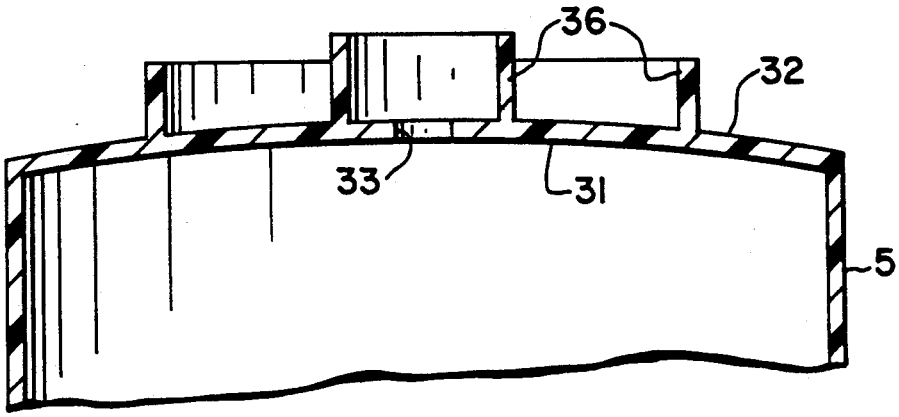
FIG. 5A is a sectional view taken along line 5A—5A of FIG. 5 with the container inverted.

The outer bottom surface 32 of the tank 5 is adopted to be supported by and cooperate with the mounting surface 43 of the pallet base 3 when the tank 5 is mounted to the pallet base 3. The outer bottom surface 32 preferably corresponds and mates with the mounting surface 43 of the pallet base 3 throughout a substantial portion of their contiguous surfaces. Alternatively, depending on the strength of the materials from which the tank 5 and pallet 3 are made and the loads to be carried by these elements, the outer bottom surface 32 of the tank 5 and the mounting surface 43 of the pallet base 3 can be provided with spaced projections, for example, radially projecting ridges 34 or concentric rings 36 as shown in FIGS. 4 and 5, respectively. FIGS. 4A and 5A illustrate sectional views of FIGS. 4 and 5, respectively, taken along lines 4A—4A and 5A—5A of FIGS. 4 and 5, respectively.

If the projections are provided to only one of the surfaces, the interengagement of the outer bottom surface 32 and mounting surface 43 will be less than if the two opposing surfaces are congruent. On the other hand, if the outer bottom surface 32 is provided with projections which are adopted to nest within corresponding recesses in the mounting surface 43, there will be substantially continuous interengagement between these two surfaces. The provision of projections or ridges in the bottom will strengthen or impart greater rigidity to the bottom wall of the tank.

Figure 6:
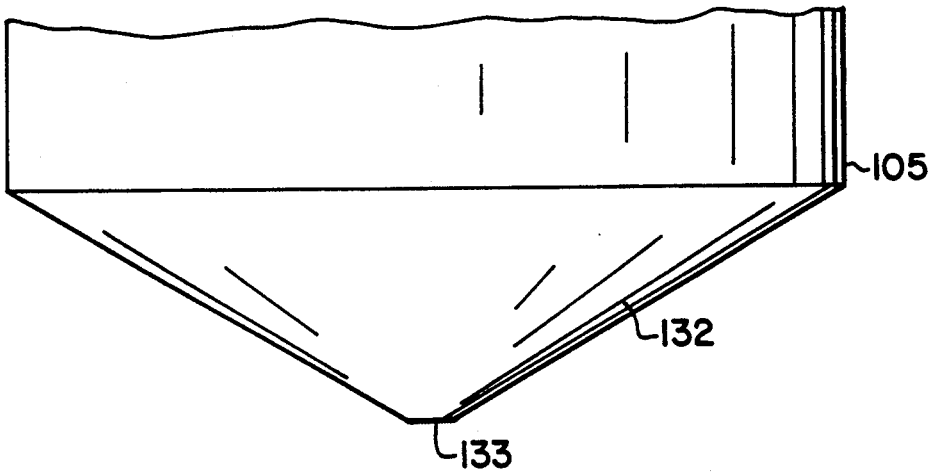
FIG. 6 is an elevational view showing a modified container bottom having a conical configuration.

Furthermore, the shape of the inner and outer bottom surfaces 31 and 32, respectively, of the tank 5 can be, for example, cone-shaped (FIG. 6), pyramid-shaped (FIG. 7), oval (not illustrated), or other shapes based on design preferences. In FIG. 6, tank 105 is identical to tank 5 as described in FIGS. 1–3 except for the conical bottom 132. Drain opening 133 located at the lower-most point of the conical bottom 132 in this example.

Figure 7:
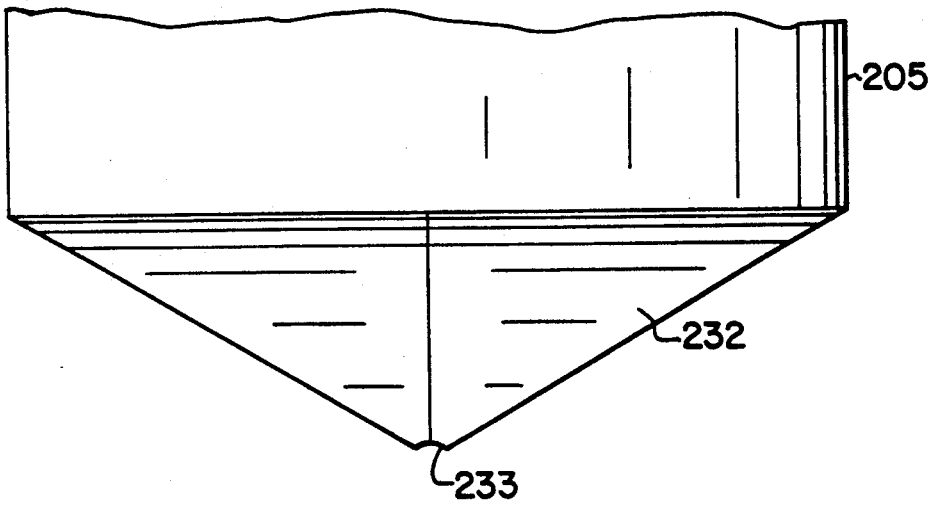
FIG. 7 is a elevational view showing a modified container bottom having a pyramidal exterior surface.

Tank 205 shown in FIG. 7 is identical to tank 5 as described in FIGS. 1–3 except for the pyramidal shaped bottom 232. The drain opening 233 is located at the lower-most point of the pyramidal bottom 232 in this example.

Figure 8:
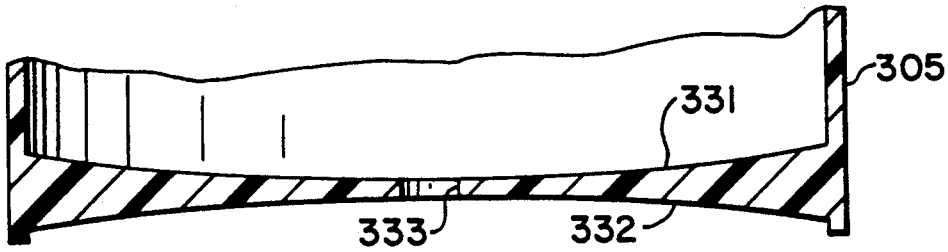
FIG. 8 is a vertical sectional view showing a modified container bottom configuration having a concave exterior surface.

The outer bottom surface of the tank also can be flat or of a concave shape while maintaining a sloped inner surface 31 as shown in FIG. 8. Tank 305 illustrated in FIG. 8 is identical to tank 5 described in FIGS. 1–3 except for the concave outer bottom surface 332. The drain opening 333 is located at the center of the bottom of tank 305 and the inner bottom surface 331 is sloped toward the drain opening 333. Of course, the upper supporting surface of the pallet will be configured to mate with the outer bottom surface 332 of the tank 305.

Figure 10:
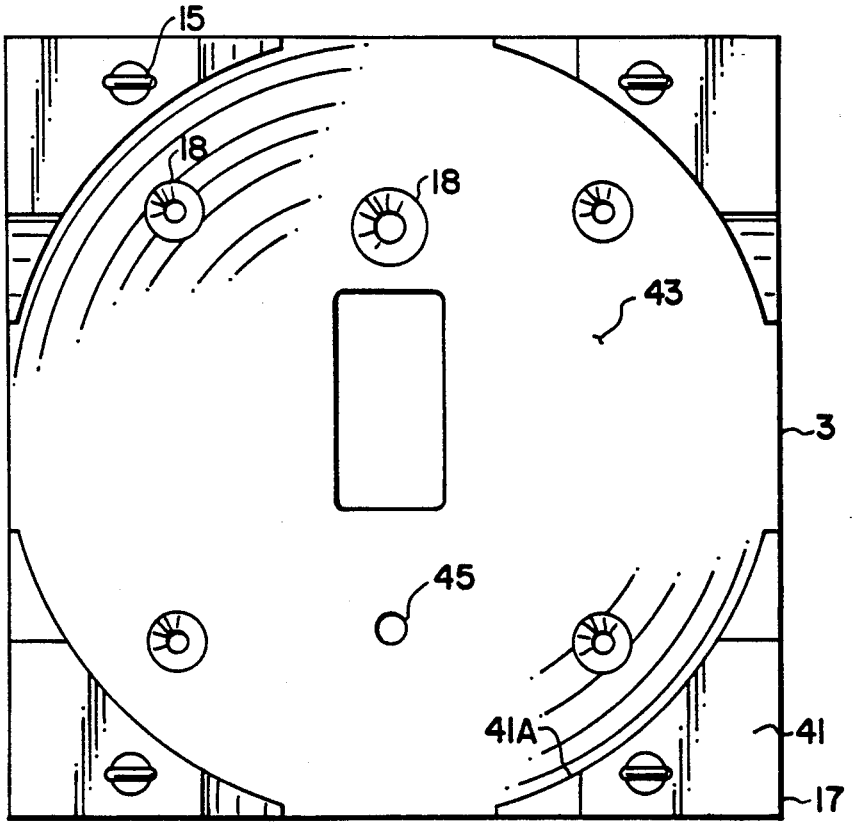
FIG. 10 is a top plan view of the pallet looking along lines 10—10 in FIG. 1.

As shown in FIG. 3, the drain hose 19 attaches to the fitting 20 which further attaches to the drain opening 33 to direct the fluid exiting the tank 5. Extending downward from the outer bottom surface 32 of the tank 5 is at least one locating pin 39 which cooperates with locating notch 45 in the mounting surface 43 of the pallet base 3 to align the tank 5 in a predetermined orientation or position on the pallet base 3. The locating notch 45 is shown in FIGS. 3 and 10. However, if alternative non-symmetrical or non-circular configurations of the outer bottom surface 32 are selected, the locating pin can be eliminated since the orientation of the container with respect to the pallet will be determined by the mating of the non-symmetrical or non-circular configurations of the outer bottom surface of the tank and the corresponding mating mounting surface of the pallet.

Figure 9:
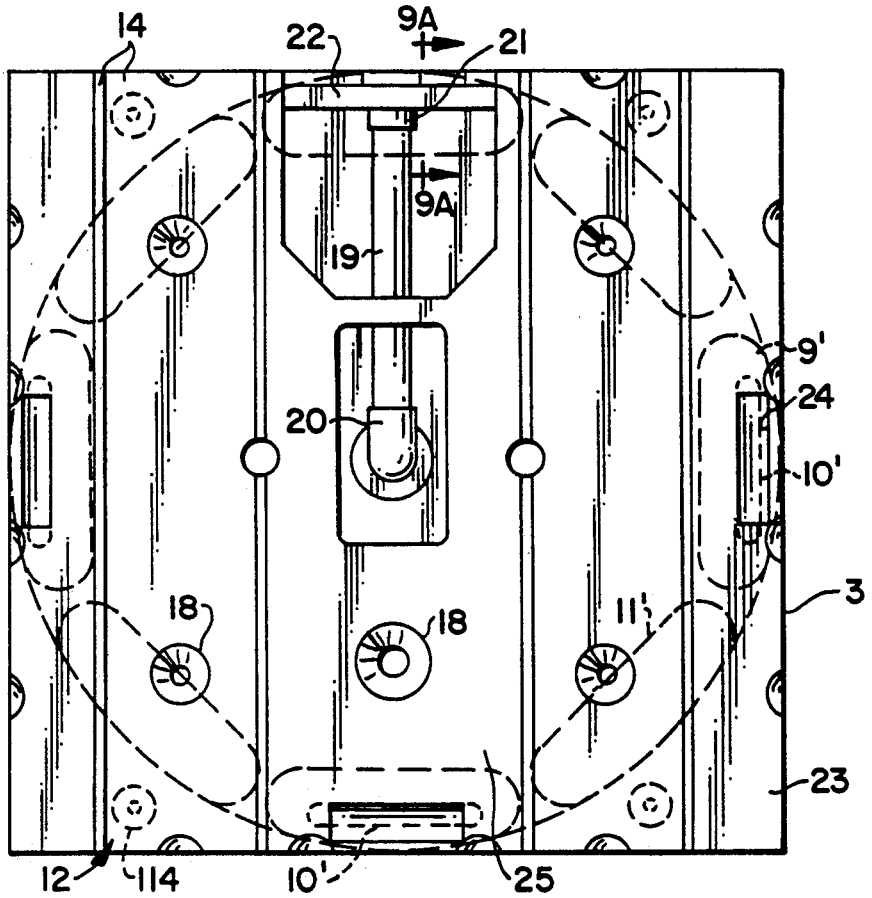
FIG. 9 is a bottom plan view of the pallet looking along lines 9—9 in FIG. 1.

As shown in FIG. 9, the pallet base 3 is designed to cooperate with the top of a like portable container assembly to enable the portable container assembly 1 to be stacked upon another like portable container assembly 1' as shown in FIG. 2. The footprint of the pallet base 3 is generally rectangular and, according to this embodiment, has a length and width of approximately 48 inches (square), respectively. The size and shape of the pallet base 3 can be polygonal, etc. based on design choice.

In addition, the pallet base 3 in this embodiment is hollow and includes a plurality of rigidity imparting openings 18 disposed therein. As shown in FIG. 3, the openings 18 are defined by frustrum sections 18A and 18B which connect or merge approximately mid-way through the pallet base 3 in the vertical direction. Based on design choice, the shape (e.g. hollow columnar shape), number and size of the rigidity imparting openings 18 can vary or the pallet base 3 can be solid depending on structural necessity.

As further shown in FIG. 9, the footprint of the pallet base 3 in this embodiment comprises vertical side projections 23 each disposed at opposite sides of the pallet base 3 along the perimeter of the footprint of the pallet base 3. The pallet base 3 further comprises a central projection 25. Openings 24 are disposed in each vertical side projection 23 and in the central projection 25 of the pallet base 3 at a location proximate to an end of the pallet base 3 opposite to the location of the drain valve 21 to receive the upper projections 10' (as shown by broken lines) of one of the first projections 9' (as shown by broken lines) of the top 7' of a like portable container 1' during stacking of the portable container assemblies 1 and 1' to prevent relative lateral movement of the stacked portable container assemblies 1 and 1' (see FIG. 2).

Figure 9A:
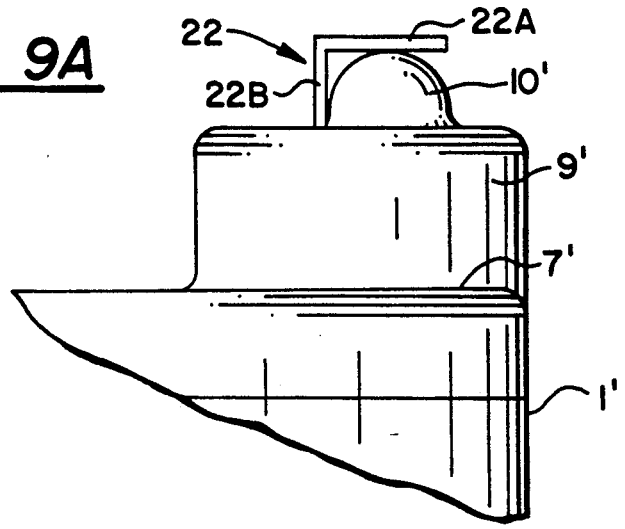
FIG. 9A is a side view of a portion of stacked container assemblies illustrating the cooperation of the pallet bracket assembly with the first projection and upper projection of the underlying top looking along lines 9A—9A in FIG. 9.

As shown in FIG. 9A, the pallet bracket assembly 22, which in the illustrated embodiment has an L-shaped cross-section, cooperates with one of the first projections 9' of the underlying top 7' of a like portable container assembly 1' to further stabilize the stacking of the portable container assemblies 1 and 1'. The top portion or leg 22A of bracket assembly 22 extends radially of the axial center of the top 7' of the like portable container assembly 1' and contacts the top surface of upper projection 10' of the first projection 9' while the vertically extending leg 22B of the bracket assembly 22 engages the inner surface of projection 10'. If desired, the lower edge of the leg 22B can engage the upper surface for the projection 9'. Hence, the bracket assembly 22 receives the upper projection 10' of one of the first projections 9' to prevent the portable container assembly 1 from tipping during stacking and to further prevent relative lateral movement of the stacked portable container assemblies 1 and 1'.

Figure 9B:
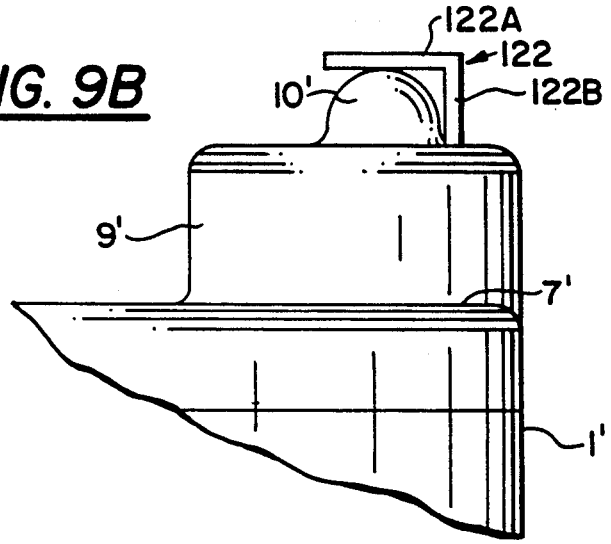
FIG. 9B is a side view of a portion of stacked container assemblies illustrating the cooperation of an alternative pallet bracket assembly with the first projection and upper projection of the underlying top.
Figure 9C:
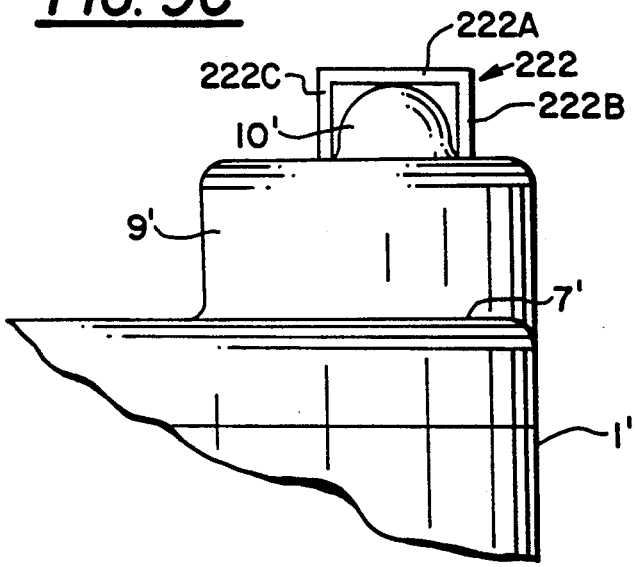
FIG. 9C is a side view of a portion of stacked container assemblies illustrating the cooperation of an alternative "U"-shaped pallet bracket assembly with the first projection and upper projection of the underlying top.

Alternative shapes of the bracket assembly 22 are illustrated in FIGS. 9B and 9C. In FIG. 9B, the upper leg 122A of bracket assembly 122 projects toward the axial center of the top 7' of the like portable container assembly 1' and contacts the top of upper projection 10' of the first projection 9' while the inner surface of the vertically extending leg 122B of the bracket assembly 122 contacts the outer surface of projection 10'. Hence, similar to bracket assembly 22, bracket assembly 122 receives the upper projection 10' of one of the first projections 9' to prevent the portable container assembly 1 from tipping during stacking and to further prevent relative lateral movement of the stacked portable container assemblies 1 and 1'.

FIG. 9C shows the bracket assembly 222 as being "U" shaped and comprising a top portion 222A and two side portions or legs 222B and 222C. The top portion 222A of bracket assembly 222 contacts the top of upper projection 10' of the first projection 9' while the inner surfaces of side portions 222B and 222C of the bracket assembly 222 abut against upper projection 10'. If desired, the bottom edge of each leg 222B and 222C can engage the top of the first projection 9'. Hence, bracket assembly 122 receives and covers the upper projection 10' of one of the first projections 9' and thereby prevents the portable container assembly 1 from tipping during stacking and further prevents relative lateral movement of the stacked portable container assemblies 1 and 1'. Of course, other shapes and configurations of the bracket assembly can be made according to design choice.

The central projection 25 of the pallet along with the side projections 23 support the portable container assembly 1 when the portable container assembly 1 is sitting on a flat surface such as a storage room floor. Side projections 23 and central projection 25 of the pallet base 3 rest on opposing end portions of the second projections 11' of the top 7' of a like container assembly 1' when the portable container assembly 1 is stacked on top of the like portable container assembly 1'. Side projections 23 further rest on the first projections 9' with upper projections 10' interengaging with openings 24 when the portable container assembly 1 is stacked on top of the like portable container assembly 1'. The relative positions of the first and second projections 9' and 11', respectively, of the top 7' of the like portable container 1' with respect to the side projections 23 and central projection 25 of the pallet base 3 and the interengagement of the upper projections 10' with the openings 24 are illustrated in FIG. 9 by broken lines.

The top of the pallet base 3 is shown in FIG. 10. Each corner section 17 of the pallet base 3 comprises an upper portion 41. Each upper portion 41 is shaped to cooperate with the outer periphery of the tank 5 to enable the tank 5 to be mounted on the pallet base on mounting surface 43. In the embodiment illustrated, the interior surface 41A of each upper portion 41 is arcuately shaped so as to correspond with the arcuate exterior configuration of the tank 5. In the preferred embodiment of the invention, the mounting surface 43 is concave to cooperate with the convex outer bottom surface 32 of the tank 5 when the tank 5 is mounted to the pallet base 3. At least one locating notch 45 is disposed at a predetermined position on the mounting surface 43. The locating notch(es) 45 cooperate(s) and receives the locating pin(s) 39 disposed on the outer bottom surface 32 of the tank 5 to orient the tank 5 in a predetermined position and to prevent the tank 5 from rotating when the tank 5 is mounted to the pallet base 3. Alternatively, if the outer bottom surface 32 of the tank 5 is shaped, for example, as in FIGS. 4–8, the mounting surface 43 is formed in a complementary shape to cooperate with the outer bottom surface 32.

Figure 11:
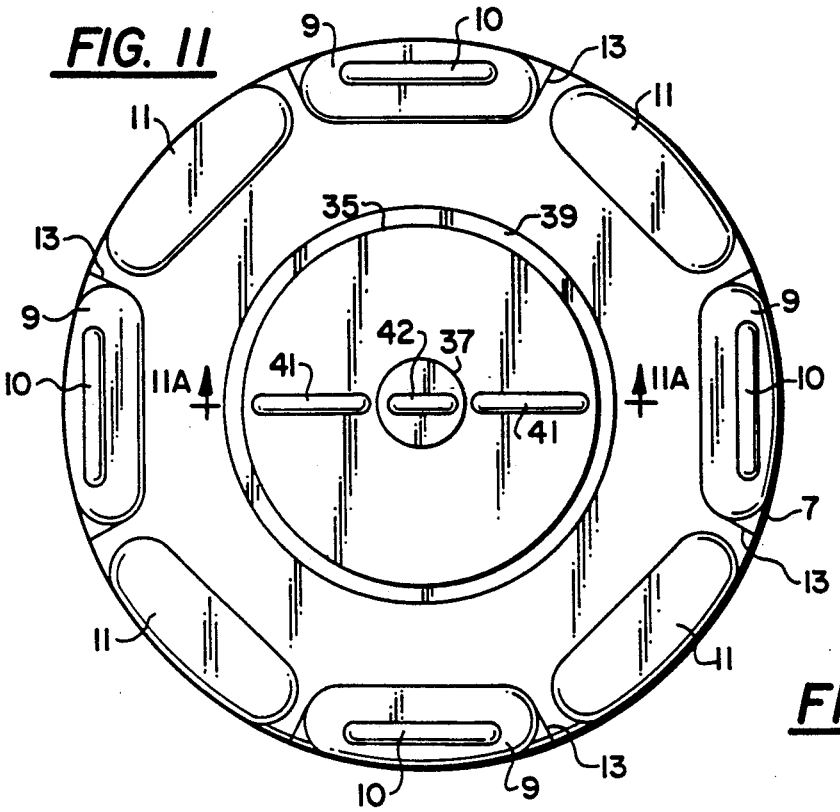
FIG. 11 is a top view of the tank looking in direction 11—11 in FIG. 1.

Details of the top 7 are shown in FIG. 11. The top 7 is approximately 48 inches in diameter, although this diameter and shape may vary in accordance with variations in the overall diameter and shape of the tank 5. The first projections 9 and second projections 11 are shown as being approximately equal in size and alternately disposed about the perimeter of the top 7. Each of the fastening cables 13 pass around one of the first projections 9 and are fastened at opposite ends with screws, bolts or the like to adjacent ends of adjacent corner section 17 of the pallet base 3 thereby securing the tank 5 to the pallet base 3. Alternatively, the fastening cables 13 can pass around the second projections 11 to secure the tank 5 to the pallet base 3. A further alternative contemplates having the cables pass over the top surface of the top 7 of the tank 5 with each end of the cables 13 secured to a corner section 17 of the pallet. Of course, any arrangement of the cables 13 can be selected based on design choice.

The top 7 further comprises at least one inner removable portion 35 which is seated within an opening 38 formed in the top 7 of the tank 5 and can be removed to expose the opening 38. The inner removable portion 35 in this embodiment is a commercially available threaded lid such as a "McPhee Enterprises (of Mississauga, Ontario) 21 inch ID lid with air-breather vent" that includes a breather cap 37 which is continuously vented to the atmosphere. The removable portion 35 has an outer flange having a diameter of approximately 24 inches and is configured to cooperate with an opening in the top 7 approximately 21 inches in diameter. As shown in FIG. 11A, the opening 38 is provided with a ring 39 mounted along the perimeter of the opening 38 with screws, rivets or the like and having threads 40A therein. As an alternative, the threads 40A may be directly molded in the perimeter of the opening 38.

Through this opening 38, more fluid may be added or a mixing device (not shown) may be inserted to stir the fluid in the tank. The outer perimeter of the engaging portion of the inner removable portion 35 comprises threads 40B which are adapted to threadingly interengage the threads 40A in the ring 39. Projections 41 can be grasped by suitable means to screw the inner removable portion 35 into the ring 39 thereby causing the threads 40B of the inner removable portion 35 engage with the threads 40A in the ring 39 to form a fluid tight seal between the inner removable portion 35 and the top 7. Projection 42 can be used by an operator to screw the breather cap 37 into the opening 37A.

Alternate configurations of the ring 39 and inner removable portion 35 and alternate methods for removably securing the inner removable portion 35 to the top 7 can be chosen based on design preference. For example, a cross section of an optional removable portion 135 is shown in FIG. 11B. Similar to inner removable portion 35, the outer perimeter of the inner removable portion 135 comprises threads 140B which are adapted to threadingly interengage the threads 40A in the ring 39. Projections 141 can be grasped by suitable means to screw the inner removable portion 135 into the ring 39 thereby causing the threads 140B of the inner removable portion 35 engage with the threads 40A in the ring 39 to form a fluid tight seal between the inner removable portion 135 and the top 7.

Inner removable portion 135 further comprises a cylindrical breather cap 137, approximately 5 inches in diameter, which can be positioned to provide a breather opening. By fully removing the breather cap 137 from the threaded opening 137A, a breather opening of approximately 5 inches in diameter is provided through which gases can escape or fluid can be added or removed via a hose and pump mechanism (not shown). Cooperating threads can be provided in the breather cap 137 and the opening 137A in the inner removable portion 135 and projection 142 can be used by an operator to screw the breather cap 137 into the opening 137A. The interengagement of the cooperating threads in the breather cap 137 and the opening 137A form a fluid tight seal between the breather cap 137 and the opening 137A when the breather cap 137 is screwed into the opening 137A.

Figure 11C:
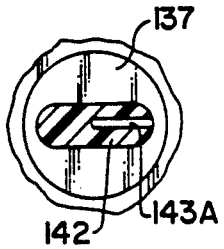
FIG. 11C is a sectional view along line 11C—11C in FIG. 11B showing the opening in projection of the alternative breather cap.
Figure 11A:
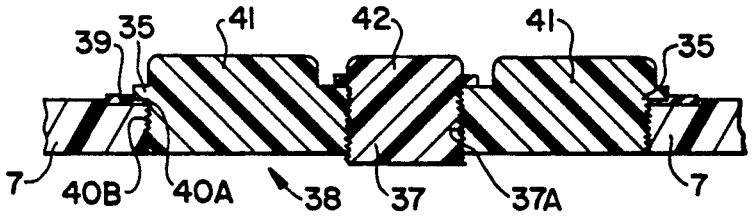
FIG. 11A is a sectional view along line 11A—11A in FIG. 11 showing the engagement of the removable portion with the container top.
Figure 11B:
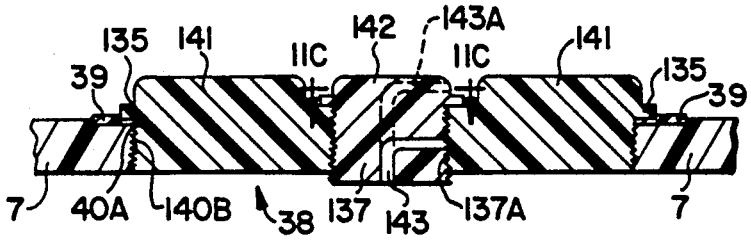
FIG. 11B is a cross sectional view of an alternative removable portion of the container top.

As further illustrated in FIGS. 11B and 11C, the breather cap 137 can be further provided with at least one opening 143 which will provide communication between the inside of the tank 5 and the exterior atmosphere when the breather cap 137 is partially unscrewed. When the breather cap 137 is screwed tightly into the opening 137A, a seal will be formed which will prevent communication between the interior of the tank and the atmosphere. Alternatively, an opening 143A can be located so as to extend through the projection 142 so that the interior of the tank will always be vented to the atmosphere even when the breather cap is tightly screwed into the opening 137A. In this last mentioned embodiment which is illustrated by broken lines in FIG. 11B and further illustrated in FIG. 11C, vapors or gases which build up within the tank will be continuously vented from the tank but moisture such as rain will be prevented from entering the tank.

Although the above dimensions for the removable portion 35 and breather cap 37 are specified for this example, their size and shape may vary according to design preference. Furthermore, as stated previously, one of the removable portions can act as a breather cap through which gases can escape and fluid can be added or removed via a conventional hose and pump mechanism. However, any removable portion can be equipped with a breather cap 37 or conventional breather valve (not shown) to enable gases to escape and fluid to be added or removed.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A container assembly for storing fluid, comprising:

a hollow container having a top, an intermediate portion and a bottom;

a pallet base having an upper container supporting surface and a lower surface;

means for removably securing the hollow container to the pallet base;

sealable drain means for communicating the interior of the container with the exterior thereof, said drain means being positioned on the bottom of the container substantially along a longitudinal axis of said container;

discharge valve means and at least one discharge hose connecting the sealable drain means to the discharge valve means, the discharge valve means enabling the fluid stored in the container to be drained at a predetermined rate; and a bracket for securing the discharge valve means to the pallet base;

the top of the container having upwardly extending projection means extending outward from an outer surface of the top in a direction substantially parallel to the longitudinal axis of the container;

the securing means comprising cable means for engaging the upwardly extending projection means and the pallet base to secure the container to the pallet base to form the container assembly;

the bottom of the container having an inner and outer surface, the inner surface of the bottom of the container being formed to direct, in the operative position of the container, the fluid within the container toward the sealable drain means;

the outer surface of the bottom of the container and the upper container supporting surface of the pallet base being configured to cooperatively interengage with each other to restrict relative movement between the container and the pallet base and comprising aligning means for aligning the container at a designated rotational position with respect to the pallet base;

the lower surface of the pallet base having at least one recess means for receiving said projection means on the top of a like container so that the container assembly can be stacked upon a like container assembly and relative lateral movement will be restricted therebetween;

the bracket being configured to cooperatively engage with said projection means on top of said like container to facilitate stacking and to further restrict relative lateral movement therebetween.

2. A container assembly as in claim 1, wherein the outer surface of the bottom of the container comprises a male element which is adapted to be received by and interengage with a female element formed in the upper supporting surface of the pallet base to restrict movement therebetween.

3. A container assembly as in claim 1, wherein cross sections of the outer surface of the bottom of the container normal to the longitudinal axis of the container decrease as said cross sections are taken along the longitudinal axis of the container in a direction outward of the bottom of the container.

4. A container assembly as in claim 1, wherein the upwardly extending projection means on the top of the container comprises a plurality of projections extending axially outward from the outer lateral surface of the top.

5. A container assembly as in claim 1, wherein the top is removable from the container.

6. A container assembly as in claim 1, wherein the top is integral with the container.

7. A container assembly as in claim 1, wherein the top of the container comprises an opening therein and a removable portion for covering the opening in the top of the container.

8. A container assembly as in claim 1, wherein:

the upwardly extending projection means on the top of the container comprises a plurality of projections extending axially outward from the outer lateral surface of the top;

the container is cylindrical in a horizontal cross section; and the pallet base is rectangular in a horizontal cross section.

9. A container assembly as in claim 8, wherein the outer surface of the bottom of the container is convex and the upper container supporting surface of the pallet base is concave to cooperatively interengage with the outer surface of the bottom of the container to restrict relative lateral movement between the container and the pallet base.

10. A container assembly as in claim 1, wherein the pallet base further comprises means for supporting the pallet base and a plurality of lifting hooks removably coupled to the supporting means.

11. A container assembly for storing fluid, comprising:

a hollow container having a top, an intermediate portion and a bottom;

a pallet base having an upper container supporting surface and a lower surface;

means for removably securing the hollow container to the pallet base;

sealable drain means for communicating the interior of the container with the exterior thereof, said drain means being positioned on the bottom of the container substantially along a longitudinal axis of said container;

discharge valve means and at least one discharge hose connecting the sealable drain means to the discharge valve means, the discharge valve means enabling the fluid stored in the container to be drained at a predetermined rate; and a bracket for securing the discharge valve means to the pallet base;

the top of the container having upwardly extending projection means extending outward from an outer surface of the top in a direction substantially parallel to the longitudinal axis of the container;

the securing means comprising cable means for passing over the top of the container between the upwardly extending projection means and joining to the pallet base to secure the container to the pallet base to form the container assembly;

the bottom of the container having an inner and outer surface, the inner surface of the bottom of the container being formed to direct, in the operative position of the container, the fluid within the container toward the sealable drain means;

the outer surface of the bottom of the container and the upper container supporting surface of the pallet base being configured to cooperatively interengage with each other to restrict relative lateral movement between the container and the pallet base and comprising aligning means for aligning the container at a designated rotational position with respect to the pallet base;

the lower surface of the pallet base having at least one recess means for receiving said projection means on the top of a like container so that the container assembly can be stacked upon a like container assembly and relative lateral movement will be restricted therebetween;

the bracket being configured to cooperatively engage with said projection means on top of said like container to facilitate stacking and to further restrict relative lateral movement therebetween.

12. A container assembly as in claim 11, wherein:

the upwardly extending projection means on the top of the container comprises a plurality of projections extending axially outward from the outer lateral surface of the top;

the container is cylindrical in a horizontal cross section; and the pallet base is rectangular in a horizontal cross section.

13. A container assembly as in claim 12, wherein the outer surface of the bottom of the container is convex and the upper container supporting surface of the pallet base is concave to cooperatively interengage with the outer surface of the bottom of the container to restrict relative lateral movement between the container and the pallet base.

* * * * *